US005826313A

United States Patent [19]

Ishizaki

[11] Patent Number: 5,826,313

[45] Date of Patent: Oct. 27, 1998

[54] RETAINING DEVICE FOR CLOTHES

[75] Inventor: Morio Ishizaki, Hyogo, Japan

[73] Assignee: Ishizaki Press Kogyo Co., Ltd., Hyogo, Japan

[21] Appl. No.: 779,187

[22] Filed: Jan. 6, 1997

[30] Foreign Application Priority Data

Jan. 22, 1996 [JP] Japan ..... 8-000120 U
Nov. 8, 1996 [JP] Japan ..... 8-011375 U

[51] Int. Cl.[6] ..... A44B 13/00

[52] U.S. Cl. ..... 24/694; 24/695; 24/698.2

[58] Field of Search ..... 24/694, 695, 682.1, 24/698.2, 690, 105

[56] References Cited

U.S. PATENT DOCUMENTS

| | | | |
|---|---|---|---|
| 0,573,470 | 12/1896 | Kerngood | 24/695 |
| 0,581,921 | 5/1897 | Schoeppl et al. | 24/695 |
| 0,844,486 | 2/1907 | Waterman | 24/695 |
| 0,886,241 | 4/1908 | Norton | 24/698.2 |
| 0,954,458 | 4/1910 | Patterson | 24/695 |
| 1,266,219 | 5/1918 | Curtiss | 24/695 |
| 3,426,400 | 2/1969 | Lauro | 24/695 |
| 3,892,015 | 7/1975 | Taylor | 24/201 |
| 4,437,212 | 3/1984 | Stahl et al. | 24/698.2 |

FOREIGN PATENT DOCUMENTS

| | | |
|---|---|---|
| 390 312 A | 7/1908 | France . |
| 1 541 818 | 10/1968 | France . |

OTHER PUBLICATIONS

European Search Report dated May 14, 1997.

*Primary Examiner*—Victor N. Sakran
*Attorney, Agent, or Firm*—Lowe, Price, LeBlanc & Becker

[57] ABSTRACT

Inserting member 10 used for the retaining device for clothes is formed of a plastic material, and includes a base plate 11 attached to the clothes, an inserting plate 12 having, at one end of base plate 11, a vertical portion 11*a* extending vertically from the base plate 11, a bent portion 12*b* bent to a direction parallel to the base plate from the vertical portion 11*a*, and a parallel portion 12*c* extending parallel to the base plate 11 from the bent portion 12*a*, a convex portion 15 provided on the inserting plate 12 at a position opposing to the base plate 11, and a rib 14 provided on an outer surface of the inserting plate 12 for suppressing deflection of the inserting plate 12. Accordingly, a retaining device for clothes formed of plastic, which does not cause any chemical reaction with the chemicals used for clothes and not cause any reaction of a metal detector, which has sufficient characteristics for use and suitable for mass production can be provided.

18 Claims, 17 Drawing Sheets

RETAINING DEVICE FOR CLOTHES

BACKGROUND OF THE INVENTION

1. Field of the Invention

The present invention relates to a retaining device for clothes. More specifically, it relates to a structure of a retaining device for clothes formed of a plastic material.

2. Description of the Background Art

Retaining device for clothes have been widely used at upper end portions of mens' trousers, upper end portions of skirts and for lingeries. A structure of a retaining device for clothes used at an upper end portion of trousers will be described with reference to FIG. 32.

A receiving member (straight bar eye, simply referred to as "bar") 120 formed of a metal material provided on one end 200 of trousers forms an opening 120A together with the clothes 200. Meanwhile, an inserting member (hook) 110 formed of a metal material provided on the other end 100 of the trousers has a base portion 111 to be sewn on one end 100 of the trousers, and a plate portion 112 to be inserted to the opening 120A formed by the receiving member 120 and the other end 200 of the trousers.

By using the retaining device having the above described structure, one wears the trousers fit on the body by inserting plate portion 112 of hook 110 to opening 120A of bar 120, as shown by the arrow of FIG. 32.

Now, recently, higher safety of products including clothes has been desired, as product liability act has been enforced. Accordingly, the clothes are inspected using a metal detector or the like to see if a needle or the like should be left in the clothes after garment manufacture.

However, since the conventional retaining device for clothes is formed of metal, it causes unnecessary reaction of the metal detector.

In view of the foregoing, recently, the surface of the retaining device for clothes is coated with a special coating so that the retaining device does not react to the metal detector. However, when the clothes are manufactured abroad and transported to domestic market by ship, for example, the coating and chemicals used for the clothes may possibly react, causing discoloring, as the clothes are kept sealed for a long period of time during transport by water.

SUMMARY OF THE INVENTION

Therefore, an object of the present invention is to provide a retaining device for clothes formed of a plastic material which does not react to the metal detector, not susceptible to discoloring even when subjected to long transport by water and having characteristics sufficient for use and suitable for mass production. Another object of the present invention is to provide a retaining device for clothes having such a structure that allows easy and secure attachment on the clothes.

According to one aspect, the present invention provides a retaining device for clothes attached to clothes or the like, and, for keeping the clothes fitted on one's body, including a receiving member attached to one end of the clothes and forming an opening together with the clothes and an inserting member attached to the other end of the clothes and inserted to the opening for engaging one and the other ends of the clothes, wherein the inserting member has a base plate formed of a plastic material and attached to the clothes; an inserting plate including a vertical portion extending in the vertical direction with respect to the base plate from one end of the base plate, a bent portion bent from the vertical portion to a direction parallel to said base plate, and a parallel portion extending parallel to the base plate from the bent portion, and forming, together with the base plate, a space for retaining the receiving member; a convex portion provided on an inner surface opposing to the base plate of the parallel portion of the inserting plate, serving as a stop in the direction of disengagement for the receiving member, to prevent the receiving member from slipping out of the space; and a rib provided projected outward on the outer surface of the inserting plate to suppress deflection of the inserting plate.

By the above described structure, one and the other ends of the clothes can be engaged by inserting the inserting plate of the inserting member to an opening formed by the receiving member and the clothes.

Further, since there is provided a convex portion on the inner surface of the parallel portion serving as a stop for the receiving member to the disengaging direction, the inserting member does not easily slip out from the opening. Further, since a rib is provided projecting outward from the outer surface of the inserting plate to suppress deflection of the inserting plate, elasticity of the inserting plate is improved, and hence it is possible to sufficiently secure the receiving member by the inserting plate.

Accordingly, even if a plastic member is used, rigidity comparable to that of the retaining device for clothes formed of a metal member can be obtained by the retaining device for clothes having the above described structure.

Further, as the retaining device for clothes is formed of a plastic material, it can be used in a stable state without any reaction with chemicals used for the clothes.

Preferably, the rib is provided on the outer surfaces of the bent portion and the vertical portion of the inserting plate and, more preferably, on the outer surface of the parallel portion. More preferably, the rib is formed to have two protruding portions extending parallel to each other along the direction of extension of the inserting plate.

By the provision of such a rib on the inserting plate, inserting plate can have sufficient elasticity and structural rigidity comparable to that of metal.

Further, tip end side of the parallel portion of the inserting plate is made gradually narrower toward the tip end. Therefore, the inserting member can readily be inserted to the opening formed by the receiving member and the clothes.

Preferably, the gap between the parallel portion of the inserting plate and the base plate is made larger than the thickness of the receiving member, and the gap between the convex portion and the base plate is made smaller than the thickness of the receiving member.

Therefore, when the inserting plate is to be inserted to the opening formed by the receiving plate and the clothes, the inserting plate cannot be inserted to the opening unless it is once deflected outward at the portion where the convex portion is provided. Namely, once the inserting plate is inserted to the opening, the convex portion always abut the receiving member, and therefore disengagement of the inserting plate from the opening formed by the receiving member and the clothes can be prevented.

Further, the thickness of the base plate is made approximately the same as the height of the opening formed by the receiving member and the clothes. As the rib is formed on the outer side of the inserting plate, when the inserting plate is inserted to the opening, the clothes is pressed by the rib.

Therefore, as there is pressing force from the clothes to the inserting plate, strong engagement between the inserting member and the receiving member is ensured.

Preferably, the receiving member is formed of a plastic material and has a protruding plate portion forming an opening with the clothes, and leg portions each having a hole for stitching the receiving member on the clothes provided at opposing ends of the plate portion. Preferably, the plate portion is formed protruding such that the height of the opening formed between the plate portion and the clothes is approximately the same as the thickness of the parallel portion of the inserting plate and that the width of the opening is approximately the same as the width of the inserting plate.

Because of this structure, when the inserting plate is inserted to the opening formed between the plate portion and the clothes, the inserting plate does not rattle in the opening, and strong engagement between the inserting member and the receiving member in a stable state becomes possible.

According to another aspect, the present invention provides a retaining device for clothes attached to a clothes or the like for keeping the clothes fit on one's body including a receiving member attached to one end of the clothes and forming an opening with the clothes, and an inserting member attached to the other end of the clothes and inserted to the opening for engaging one and the other ends of the clothes, wherein the inserting member includes a hook member to be inserted to the receiving member, and a hook washer member for fixing the hook member on the other end of the clothes.

Further, the hook member is formed of a plastic material and includes: a base plate attached to the clothes; an inserting plate provided on that side of the base plate which does not face the clothes, including a vertical portion extending vertically with respect to the base plate, a bent portion bent toward the direction parallel to the base plate from the vertical portion, and a parallel portion extending parallel to the base plate from the bent portion, forming a space to retain the receiving member; a convex portion provided on an inner surface of the parallel portion of the inserting plate opposing to the clothes and serving as a stop for the receiving member to the disengaging direction for preventing the receiving member from slipping out from the aforementioned space; a rib protruding outward from the outer surface of the inserting plate to suppress deflection of the inserting plate; and a plurality of hook member legs formed on the surface of the base plate on the clothes side, which can stab the clothes.

Further, the hook washer member includes a washer base formed of a plastic material and caulking holes for hook member legs provided in the washer base at positions corresponding to the hook member legs.

When the retaining device for clothes having the above described structure is used, the hook member legs provided at the hook member stab the clothes, the hook member legs protruding from the clothes are fit in the hook washer member, and the hook member legs protruding from caulking holes for the hook member legs of the hook washer member are caulked, whereby the retaining device for clothes are readily and surely attached to the clothes.

Further, preferably, the caulking hole for the hook member legs of the hook washer member is provided with a spot facing hole having larger diameter than the caulking hole on the surface not facing the clothes. Accordingly, the tip end portion of the caulked hook member leg is contained in the spot facing hole. Accordingly, the caulked portion of the hook member leg does not protrude from the hook washer member, which is desirable in view of design or appearance.

Further, as for the receiving member also, the bar member legs of the bar member stab the clothes, the bar member legs protruding from the clothes are fitted in a bar washer member, and the bar member legs protruding from the caulking holes for the bar member legs are caulked, whereby the receiving member can readily and surely be fixed on the clothes.

For the bar washer member also, by providing spot facing holes having larger diameter than the caulking hole on the surface of the caulking hole for bar member legs not facing the clothes, the tip end portions of the caulked bar member legs are contained in the spot facing holes. As a result, the caulked portions of the bar member legs do not protrude from the bar washer member, providing neat appearance/design.

More preferably, a spacer for defining a space between the main bar and the clothes may be provided at a portion of the bar member legs connecting to the main bar, so that a prescribed space can surely and readily be provided between the bar member and the clothes.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS (First Embodiment)

The structure of the retaining device for clothes in accordance with the present invention will be described with reference to the drawings.

Figure 1:
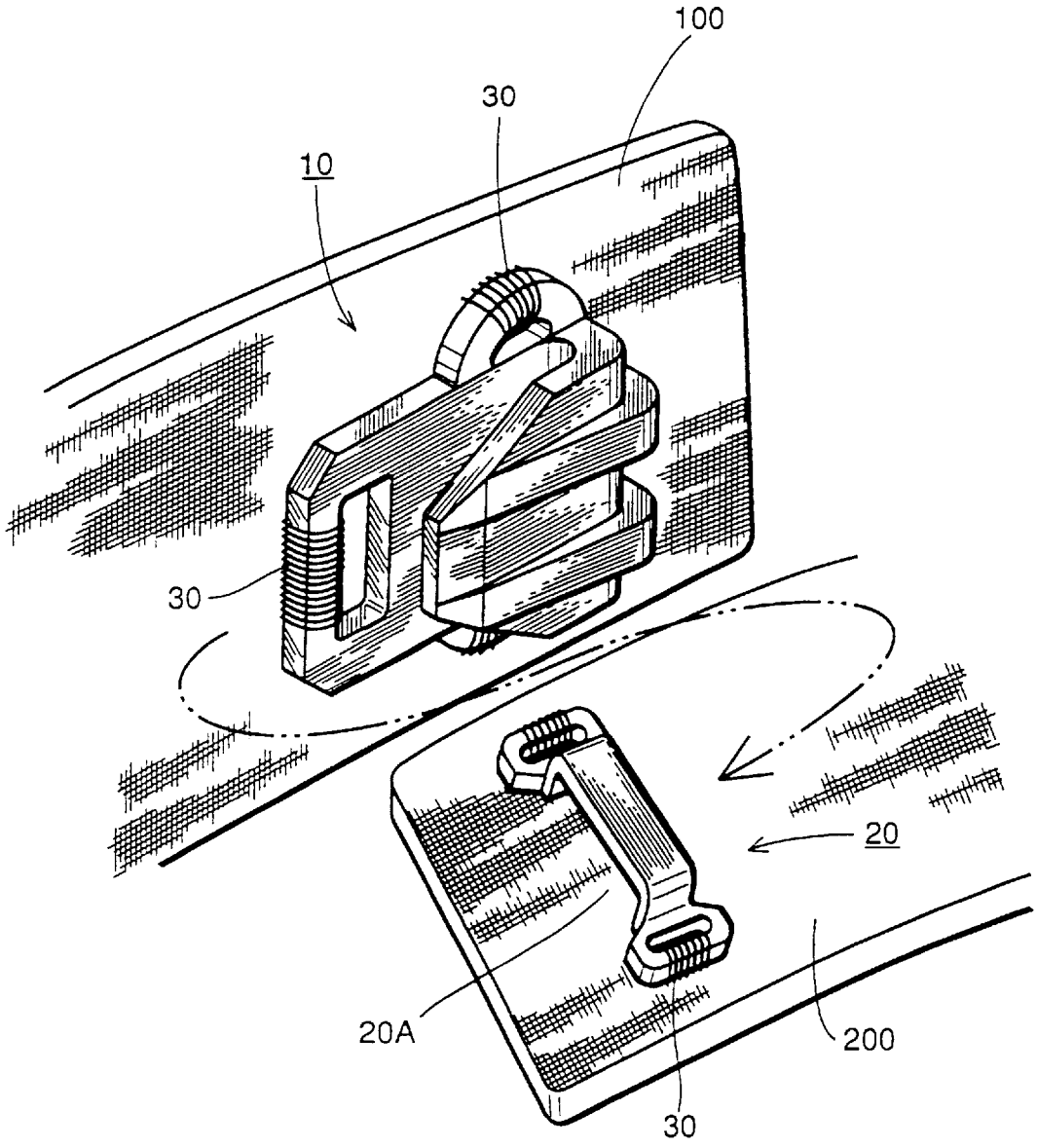
FIG. 1 is a schematic view showing the state of use of the retaining device for clothes in accordance with the first embodiment of the present invention.

Referring to FIG. 1, the state of use of the retaining device for clothes in accordance with the present invention will be described.

Similar to the prior art, the retaining device for clothes in accordance with the present invention is used at upper end portion of trousers. On one end 100 of the trousers, inserting member 10 is sewn by sewing thread 30, and on the other end 200 of the trousers, the receiving member 20 is sewn by sewing thread 30.

The inserting plate 12 of inserting member 10 is inserted to opening 20A formed by receiving member 20 and one end 200 of the trousers as represented by the arrow in the figure, whereby one end 100 and the other end 200 of the trousers can be engaged.

Figure 2:
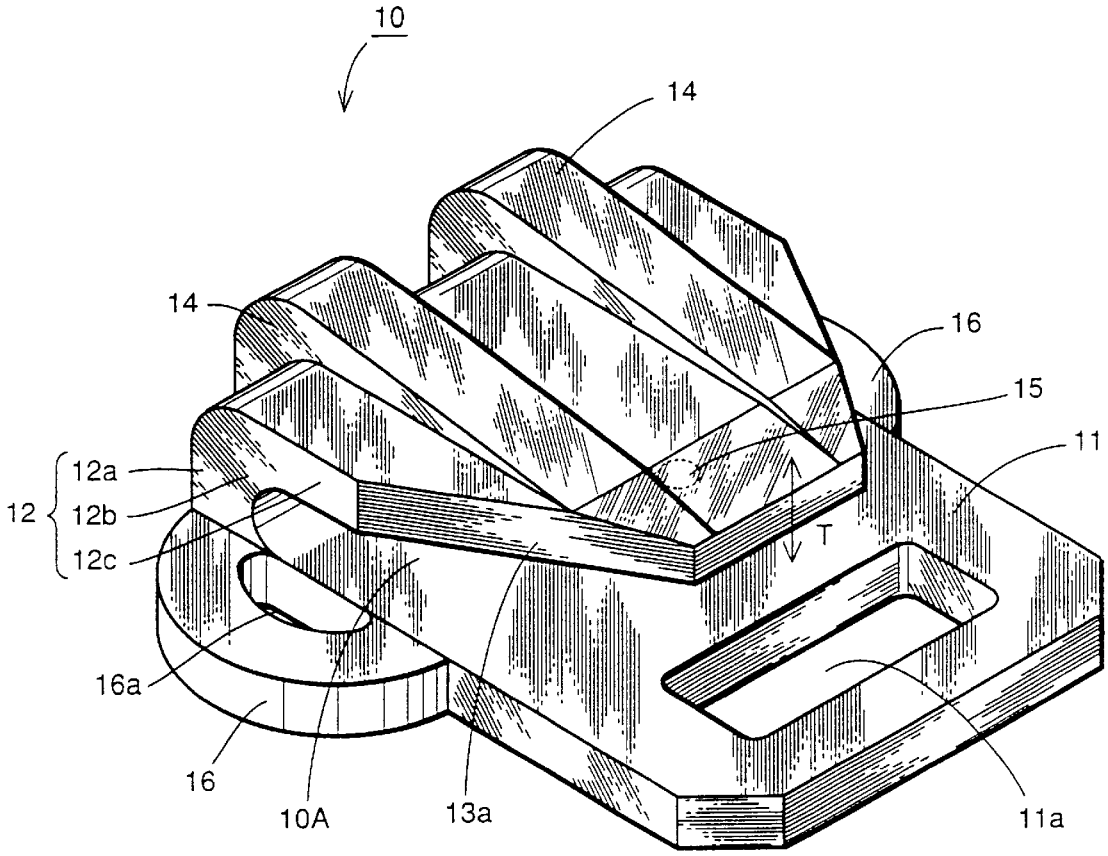
FIG. 2 is a perspective view showing the structure of the inserting member of the retaining device for clothes in accordance with the first embodiment of the present invention.

Referring to FIG. 2, the structure of the inserting member 10 will be described. The inserting member 10 of the present invention is formed of a plastic material.

The inserting member 10 has a base plate 11 which is attached to the clothes. At the tip end of the base plate 11, there is a sewing hole 11*a* for sewing the inserting member 10 on the clothes, and there are a pair of leg portions 16 on the sides of base plate 11 providing sewing holes 16*a* for sewing the inserting member 10 on the clothes.

At a rear end of base plate 11, there is formed an inserting plate 12 having a vertical portion 12*a* extending vertically from the base plate, a bent portion 12*b* bent to the direction parallel to the base plate 11 from vertical portion 12*a*, and a parallel portion 12*c* extending to the tip end parallel to the base plate 11 from the bent portion 12*b*. The inserting plate 12 forms, together with base plate 11, a space 10A for receiving the receiving member 20.

On an inner surface opposing the base plate 11 of the horizontal portion 12*c* of inserting plate 12, there is provided a convex portion 15 which serves as a stop for the receiving member 20 in the disengaging direction, so as to prevent slipping of the receiving member 20 out from the space 10A.

Further, on the outer surface of inserting plate 12, there is provided a rib 14 extending at least over the vertical portion 12*a* and bent portion 12*b*, so as to suppress deflection in the direction represented by the arrow T (in FIG. 2) of the inserting plate 12. In the present embodiment, as a most preferable example, a rib 14 including two protruding portions extending parallel to each other extends along the direction of extension of the inserting plate on the outer surface of the inserting plate, covering vertical portion 12*a*, bent portion 12*b* and horizontal portion 12*c*.

Further, the tip end portion of horizontal portion 12*c* has a taper 13*a* which becomes gradually narrower to the tip, facilitating insertion to opening 20A.

In the inserting member 10 having the above described structure, since rib 14 is provided extending at least along the outer peripheral surfaces of vertical portion 12*a* and bent portion 12*b*, deflection of inserting plate 12 can be sufficiently suppressed, and hence rigidity and elasticity comparable to those of the conventional inserting member formed of a metal member can be obtained.

Figure 3:
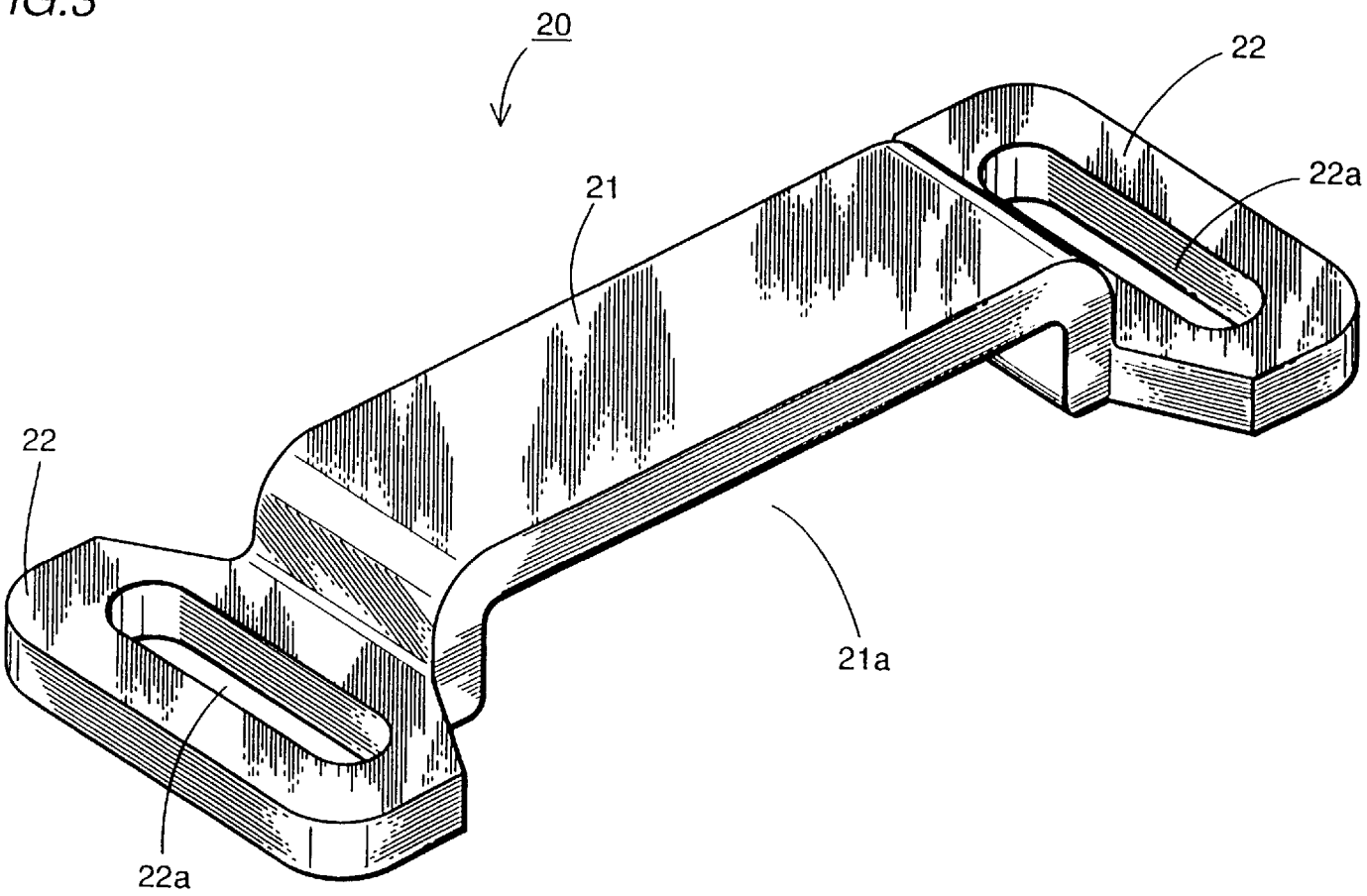
FIG. 3 is a perspective view showing the structure of the receiving member of the retaining device for clothes in accordance with the first embodiment of the present invention.

The structure of the receiving member 20 of the present invention will be described with reference to FIG. 3.

The receiving member 20 in accordance with the present invention is formed of the same plastic material as inserting member 10, and it has a protruding plate 21 forming, together with the clothes, an opening 21*a*, and leg portions 22 having sewing holes 22*a* for sewing the receiving member 20 on the clothes on opposing ends of plate 21.

Figure 4:
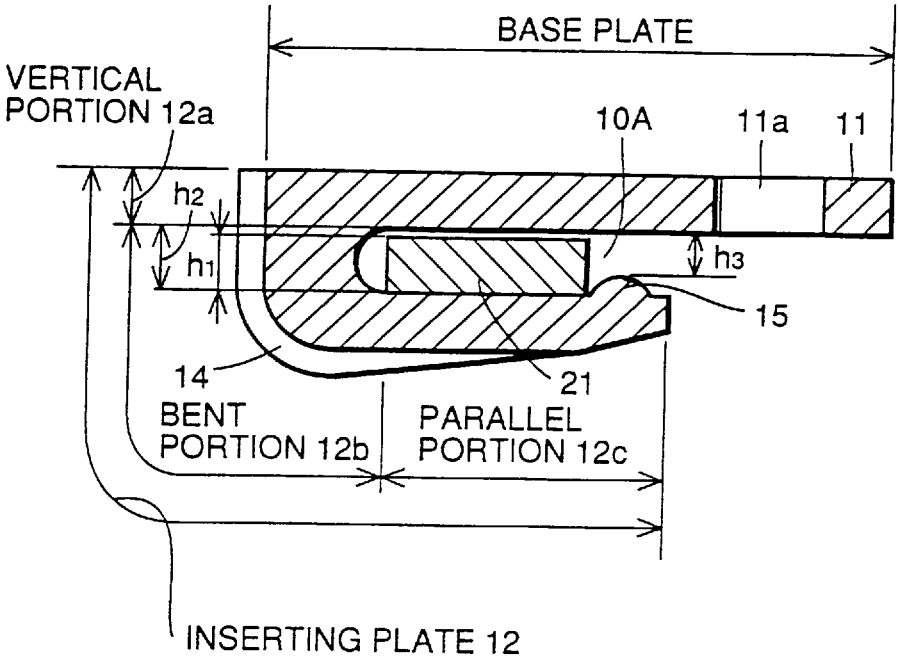
FIG. 4 is a vertical section showing dimensional relation of the retaining device for clothes in accordance with the first embodiment of the present invention.
Figure 5:
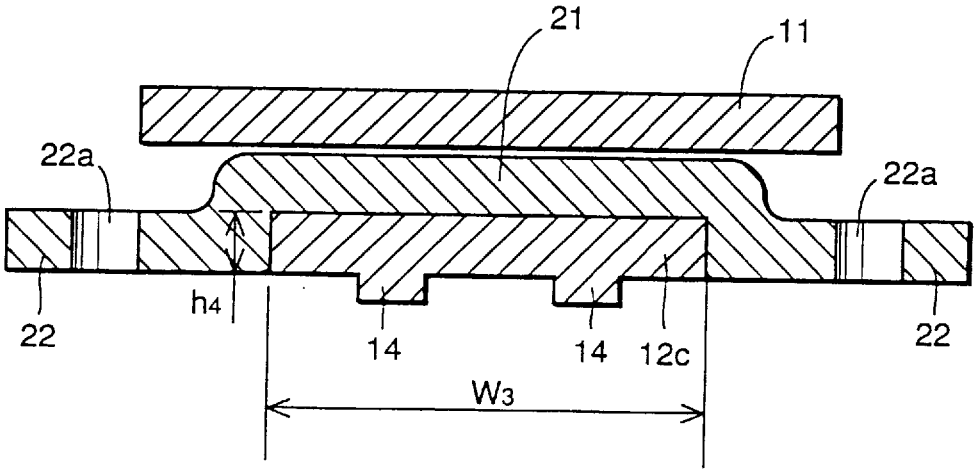
FIG. 5 is a cross section showing dimensional relation of the retaining device for clothes in accordance with the first embodiment of the present invention.

Referring to FIGS. 4 and 5, dimensional relation between inserting member 10 and receiving member 20 will be described.

First, referring to FIG. 4, the space ($h_2$) between horizontal portion 12*c* of inserting plate 12 and base plate 11 is larger than the thickness ($h_1$) of plate 21 of the receiving member, and space ($h_3$) between convex portion 15 and base plate 11 is made smaller than the thickness ($h_1$) of the plate 21 of the receiving member 20.

Therefore, when plate 21 is to be inserted to space 10A, inserting plate 12 is deflected. Therefore, once the inserting plate 20 is inserted in space 10A, convex portion 15 always serves as a stop for the plate in the disengaging direction, and hence engagement between inserting member 10 and receiving member 20 is ensured.

Next, referring to FIG. 5, the thickness of horizontal portion 112*c* should preferably be made approximately the same as the height ($h_4$) of opening 21*a* formed by receiving member 20 and the clothes. Since there is rib 14 on the outer surface of horizontal portion 112*c*, the clothes is pressed by rib 14, and there is always a force acting on horizontal portion 113 in the direction preventing slipping of plate 21 from opening 10A. Therefore, inserting member 10 and receiving member 20 can be strongly engaged.

Further, the width of the horizontal portion 12*c* should preferably be made approximately the same as the width ($W_3$) of opening 21*a* formed by receiving member 20 and the clothes.

Accordingly, when horizontal portion 12*c* is inserted to opening 21*a*, horizontal portion 12 is stably held in opening 21*a*, and hence inserting member 10 and receiving member 20 can be engaged strongly in more preferably state.

(Second Embodiment)

The structure of the retaining device for clothes in accordance with the second embodiment of the present invention will be described in the following.

Figure 6:
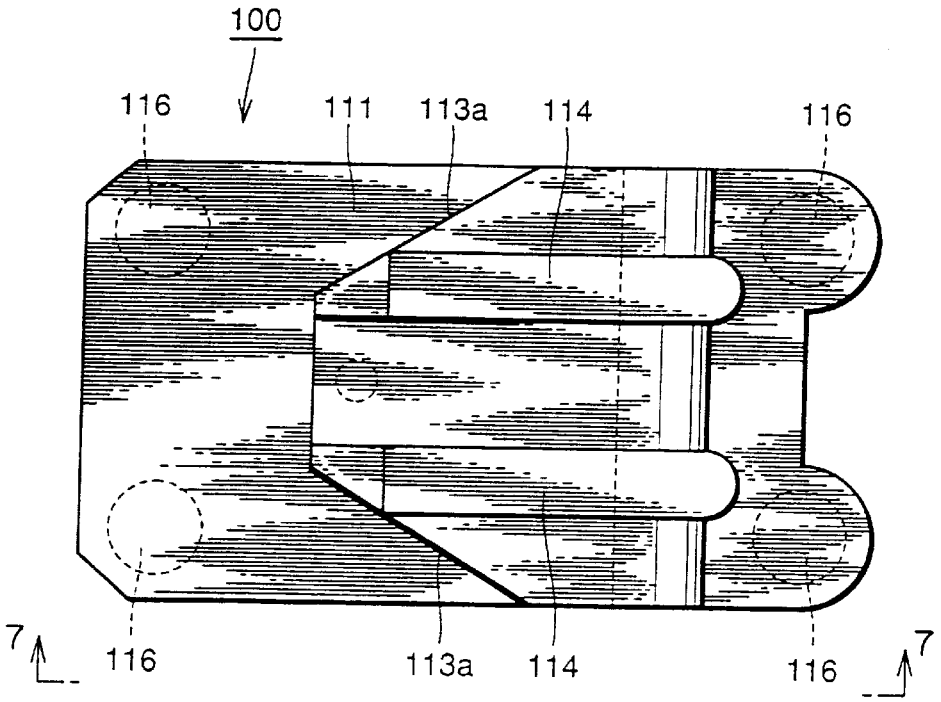
FIG. 6 is a plan view of a hook member in accordance with a second embodiment of the present invention.
Figure 7:
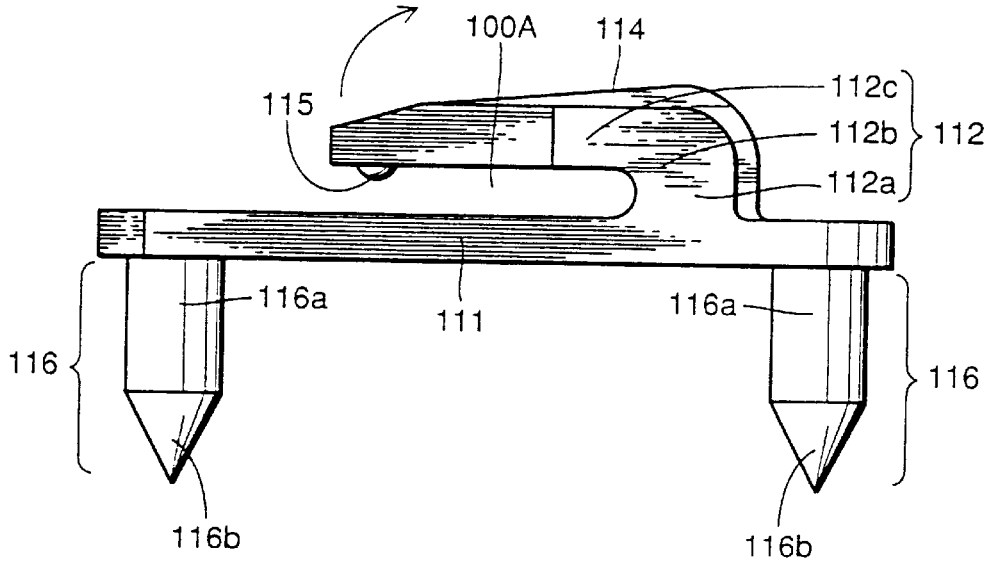
FIG. 7 is a side view taken along the line 7—7 of FIG. 6.

First, referring to FIGS. 6 and 7, the structure of a hook member 100 used for the retaining device for clothes in accordance with the present invention will be described.

Referring to these figures, hook member 100 is formed of a plastic material. Hook member 100 has a base plate 111 attached to the clothes. On the surface not facing the clothes of base plate 11, there is formed an inserting plate 112 which has a vertical portion 112*a* extending vertically from base plate 11, a bent portion 12*b* bent to a direction parallel to the base plate 11 from a vertical portion 12*a*, and a parallel portion 12*c* extending parallel to base plate 11 from the bent portion 12*b*. Inserting plate 12 forms, together with base plate 11, a space 100A for receiving the receiving member (which will be described later).

On an inner surface opposing to base plate 11 of horizontal portion 112*c* of inserting plate 12, there is provided a convex portion 15 at such a position that presents a stop for the receiving member in the disengaging direction, for preventing the receiving member from slipping out from space 100A.

Further, on the outer surface of inserting plate 112, there is formed a rib 114 extending over at least the vertical portion 112*a* and the bent portion 112*b*.

In the present embodiment, as a most preferable example, rib 114 including two protruding portions arranged parallel to each other along the direction of extension of inserting plate 112 is formed on the outer surface of inserting plate 112, extending over vertical portion 112A, bent portion 112B and horizontal portion 112*c*.

Further, the tip end portion of horizontal portion 112 has a taper 113*a* which becomes narrower toward the tip so as to facilitate insertion to the opening formed by the receiving member and the clothes.

Further, on the surface of plate 111 facing the clothes, there are hook member legs 116 at four corners of base plate 111. Hook member legs 116 each have a body 116*a* and pointed tip end 116*b*.

In the hook member 100 having the above described structure, rib 114 is provided along at least the outer peripheral surfaces of vertical portion 112*a* and bent portion 112*b*, so that deflection of inserting plate 112 is sufficiently suppressed, and hence rigidity and elasticity comparable to those of the conventional inserting member formed of a metal member can be obtained.

Figure 8:
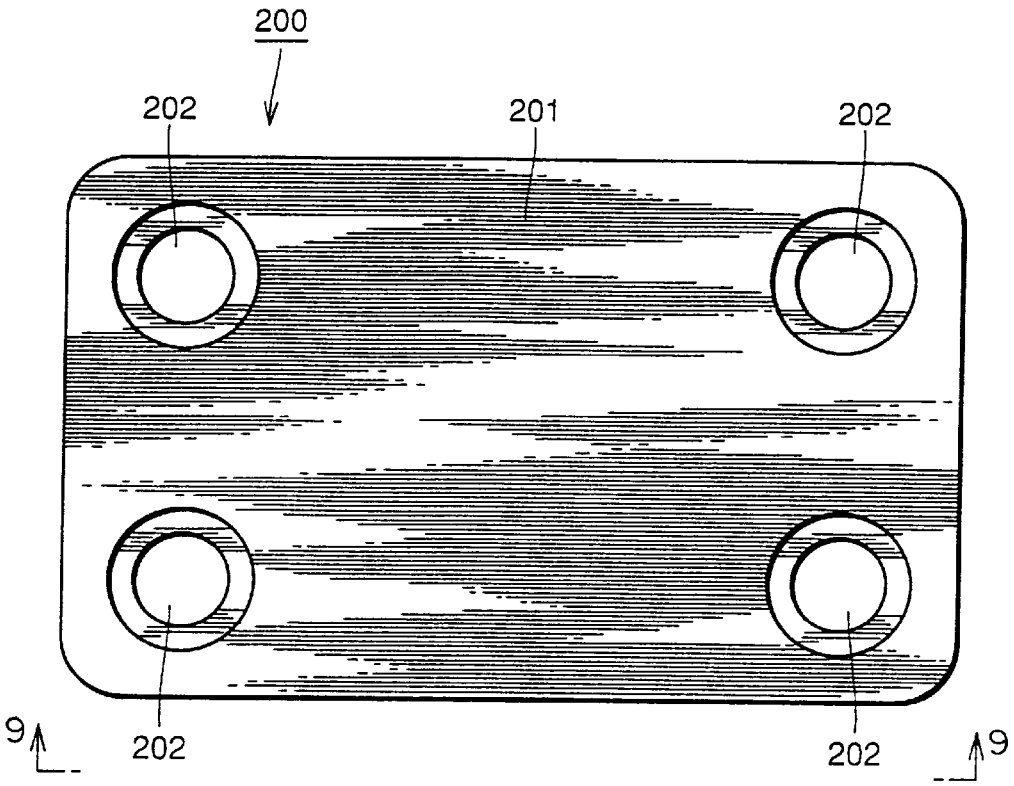
FIG. 8 is a plan view of a hook washer member in accordance with the second embodiment of the present invention.
Figure 9:
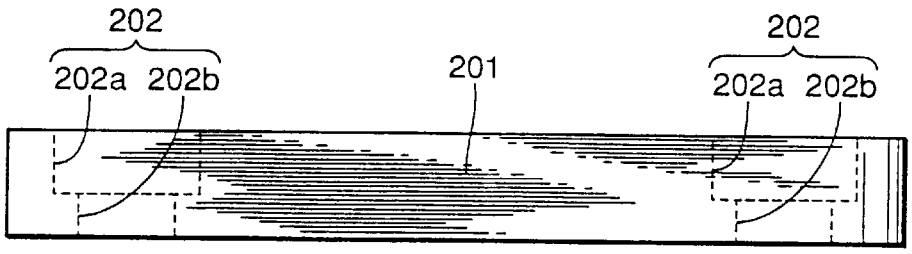
FIG. 9 is a cross section taken along the line 9—9 of FIG. 8.

Referring to FIGS. 8 and 9, the structure of hook washer member 200 used as the inserting member will be described.

Hook washer member 200 has a hook washer base 201 formed of a plastic material. Hook washer base 201 has caulking holes 202 for hook member legs at positions corresponding to hook member legs 116 provided on hook member 100. Caulking holes 202 for hook member each has a through hole 202*b* and, on the side not facing the clothes, a spot facing hole 202*a* having larger diameter than the inner diameter of through hole 202.

Attachment of the inserting member having the hook member 100 and the hook washer member 200 having the above described structure to the clothes will be described with reference to FIGS. 10 and 11.

Figure 10:
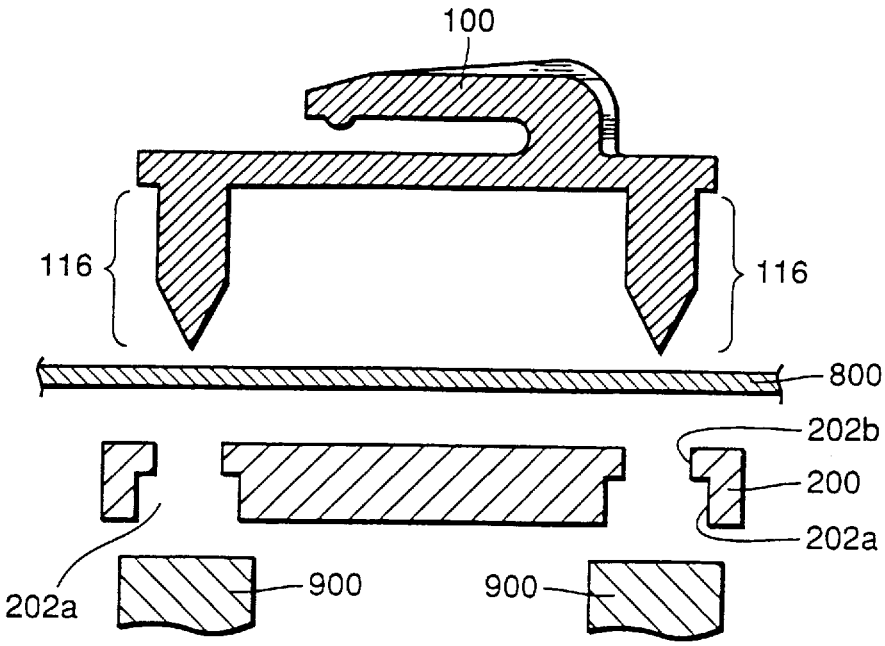
FIG. 10 is a vertical section showing a first stage of attachment of the inserting member to the clothes in accordance with the second embodiment of the present invention.

Referring to FIG. 10, hook member 100 is arranged above clothes 800, and a hook washer member 200 is placed below the clothes. At this time, hook washer member 200 is placed such that the spot facing hole 200*a* is positioned not facing clothes 800.

Then, a jig 900 for caulking hook member leg 116 is placed at a position opposing to caulking holes 202 for hook member legs. The jig 900 may be or may not be heated, provided that it can cause plastic deformation of hook member legs 116.

Figure 11:
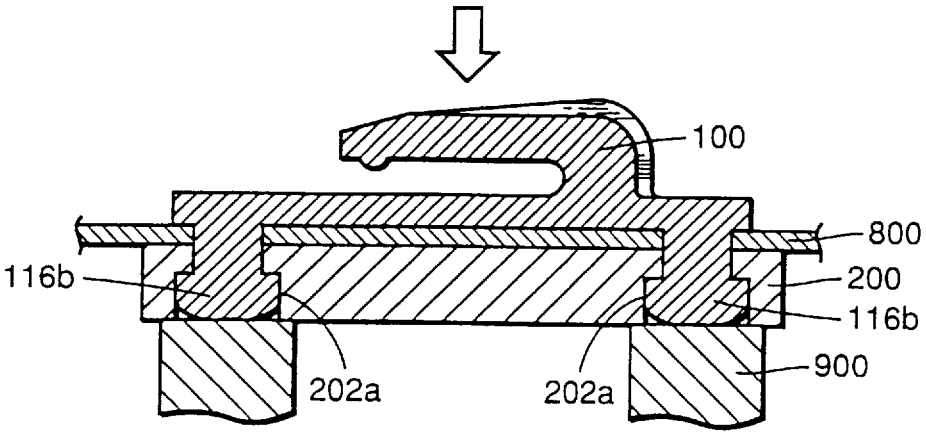
FIG. 11.is a vertical section showing a second stage of attachment of the inserting member to the clothes in accordance with the second embodiment of the present invention.

Referring to FIG. 11, the hook member leg 116 of hook member 100 stabs clothes 800, and tip end portion 116*b* of hook member leg 116 is caulked by jig 900. At this time, the caulked tip end portion 116*b* is contained deformed in spot facing hole 202*a*. Therefore, the caulked portion of hook member leg 116 does not protrude from caulking hole 202 for hook member leg, providing neat appearance. In this manner, the inserting member (hook) can readily and surely be attached to the clothes.

Figure 12:
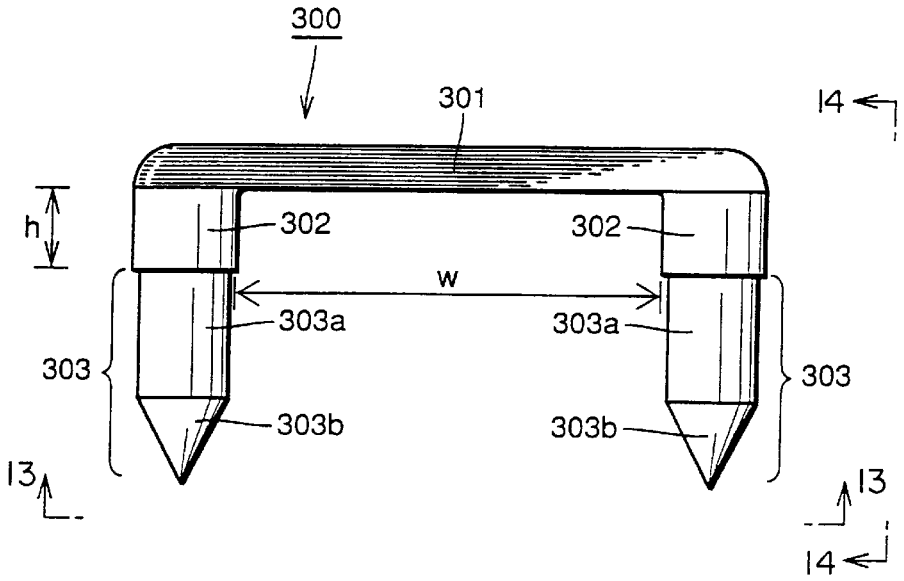
FIG. 12 is a front view of a bar member in accordance with the second embodiment of the present invention.
Figure 13:
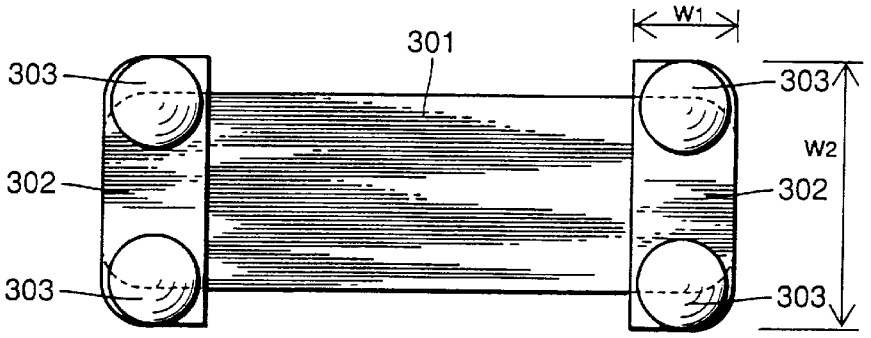
FIG. 13 is a bottom view taken along the line 13—13 of FIG. 12.
Figure 14:
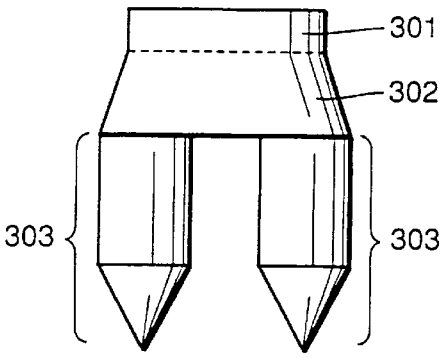
FIG. 14 is a side view taken along the line 14—14 of FIG. 12.

Referring to FIGS. 12 to 14, the structure of the bar member 300 used for the receiving member (bar) will be described.

Bar member 300 is formed of a plastic material and has an approximately rectangular main bar 301. At opposing ends of main bar 301, there are a total of four bar member legs 303, two on each side, provided with spacer 302 interposed. The bar member legs 303 each have a body 303*a* and pointed tip end 303*b*.

The height h of spacer 302 is set to be approximately the same as the thickness of parallel portion 112*c* of inserting plate 112, and the space W between spacer 302 on opposing ends is set to be approximately the same as the width of parallel portion 112*c* of inserting plate 112.

Further, at least one of the widths W1 and W2 of spacer 302 is set to be larger than the diameter of bar member legs 303.

Accordingly, the clothes stabbed by bar member leg 303 is brought into contact with spacer 302, and hence an opening to which inserting plate 112 is inserted can surely be formed between main bar 301 and the clothes.

Figure 15:
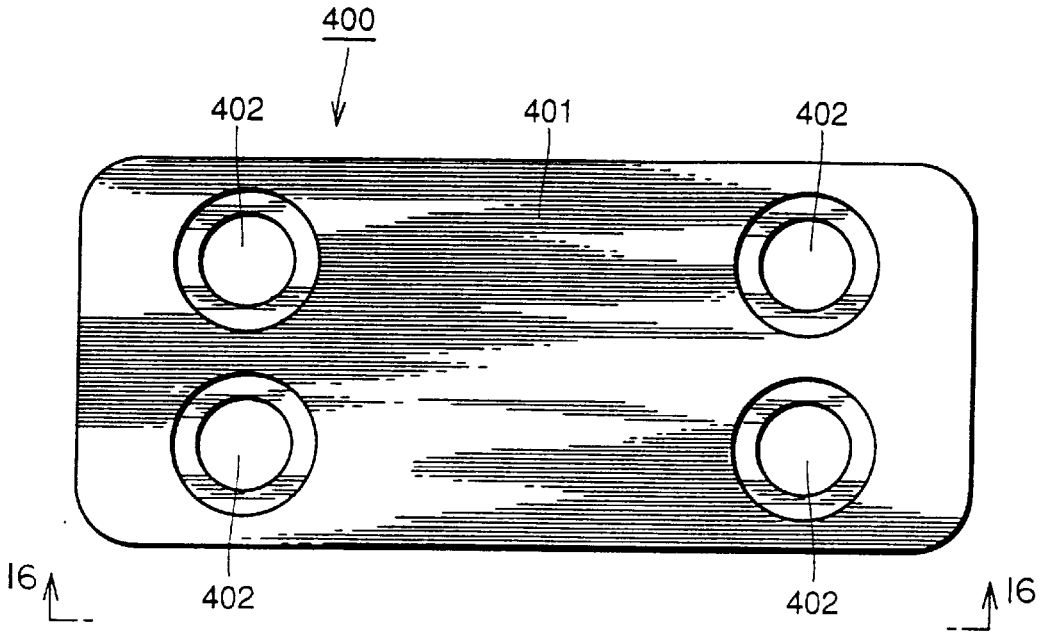
FIG. 15 is a plan view of a bar washer member in accordance with the present invention.
Figure 16:
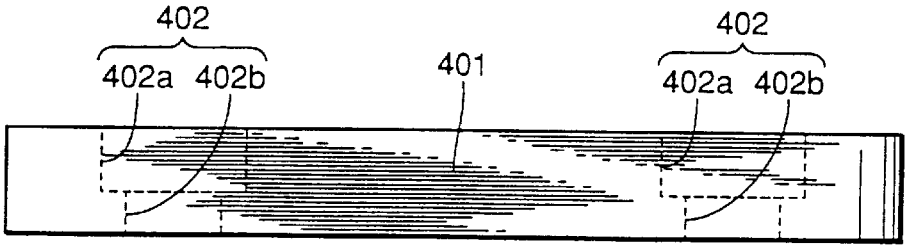
FIG. 16 is a side view taken along the line 16—16 of FIG. 15.

Referring to FIGS. 15 and 16, the structure of bar washer member 400 used for the receiving member (bar) will be described.

Bar washer member 400 has a bar washer base 401 formed of a plastic material. Bar washer base 401 has caulking holes 402 for bar member legs at positions corresponding to the bar member leg 303 provided on bar member 300. The caulking hole 402 for bar member legs each have a through hole 402*b*, and a spot facing hole 402 having larger diameter than the inner diameter of through hole 402*b* on the side not facing to the clothes.

Though bar member 300 and bar washer member 400 for four bar member legs have been described, the number of bar member legs may be two, as shown in FIGS. 17 to 21.

Figure 17:
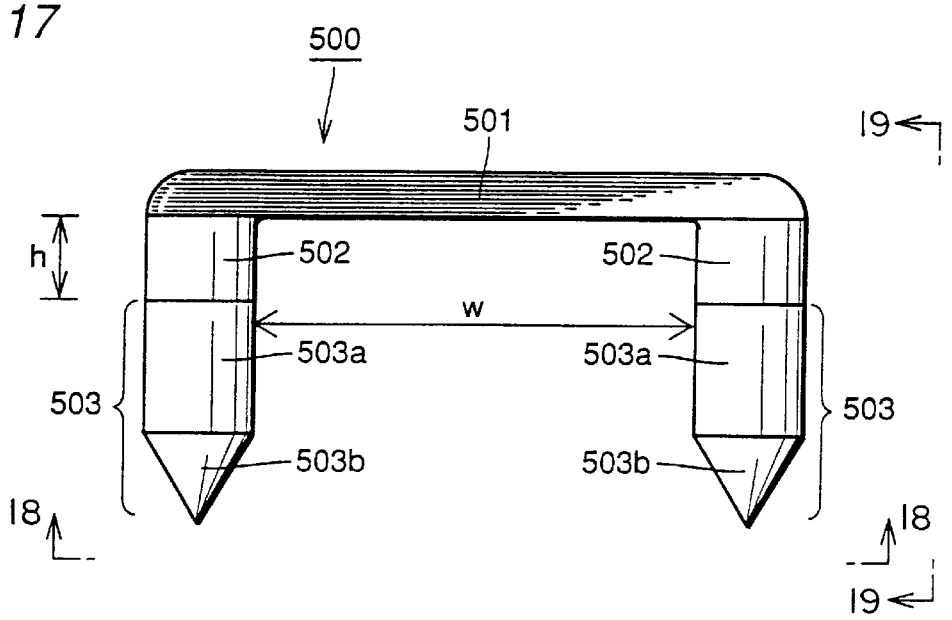
FIG. 17 is a front view of the bar member in accordance with another embodiment of the present invention.
Figure 18:
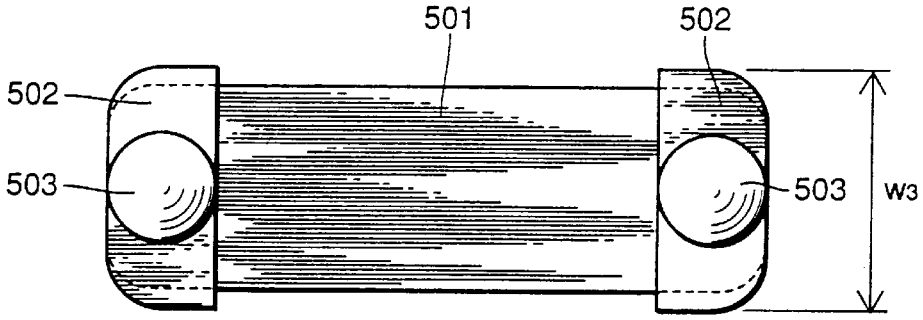
FIG. 18 is a bottom view taken along the line 18—18 of FIG. 17.
Figure 19:
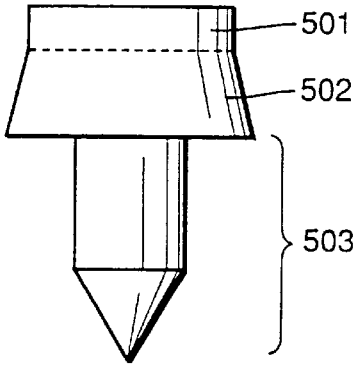
FIG. 19 is a side view taken along the line 19—19 of FIG. 17.

The structure of bar member 500 having two bar member legs will be briefly described with reference to FIGS. 17 to 19.

This bar member 500 is also formed of a plastic material similar to bar member 300, and has a rectangular main bar 501. On opposing sides of main bar 501, a total of two bar member legs 503, one on each end, are provided with spacers 502 interposed. The bar member legs 503 each have a body 503*a* and a pointed tip end 503*b*.

The height h of spacer 502 and the space W between spacers 502 on opposing ends are set in the similar manner as bar member 300. Further, the width W3 of spacer 502 is made larger than the diameter of bar member legs 503.

By such a structure also, similar function and effects as bar member 300 can be obtained.

Figure 20:
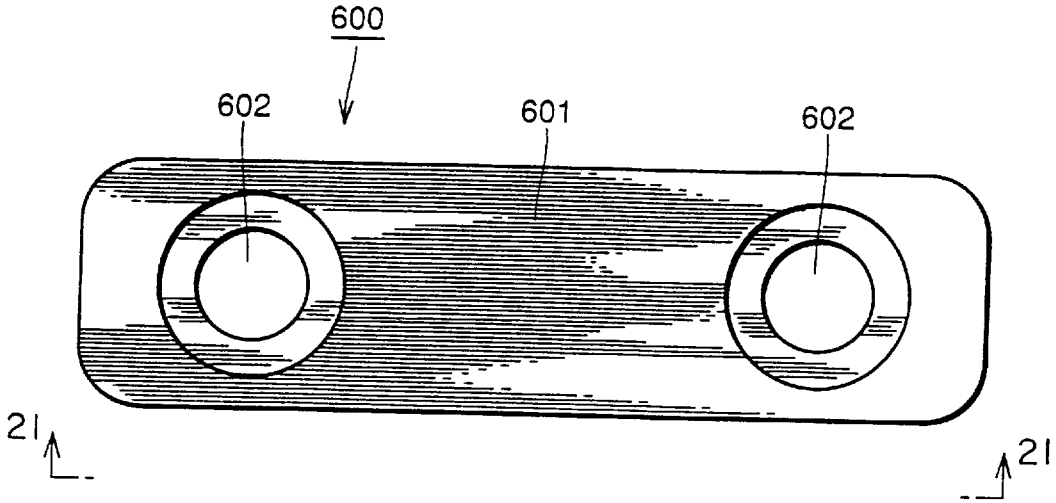
FIG. 20 is a plan view of the bar washer member in accordance with another embodiment of the present invention.
Figure 21:
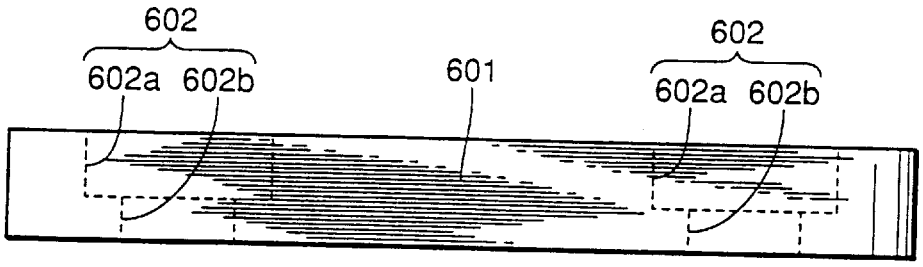
FIG. 21 is a side view taken along the line 21—21 of FIG. 20.

The structure of a bar washer member 600 corresponding to bar member 500 will be described with reference to FIGS. 20 and 21.

The bar washer member 600 has a bar washer base 601 formed of a plastic material, similar to bar washer member 400. Bar washer base 601 has caulking holes 602 for bar member legs opened at positions corresponding to bar member legs 503 provided on bar member 500.

Caulking hole 602 for bar member leg has a through hole 602*b*, and a spot facing hole 602*a* having larger diameter than the inner diameter of through hole 602*b* on the side not facing the clothes.

Figure 22:
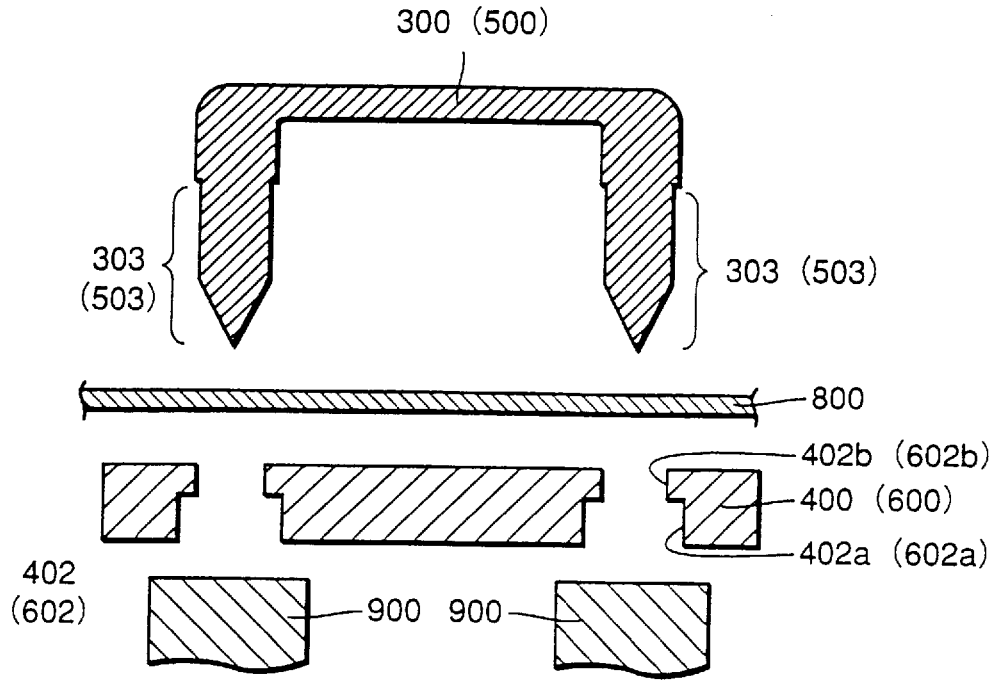
FIG. 22 is a vertical section showing a first stage of attachment of the receiving member to the clothes.

Attachment of receiving member (bar) having bar member 300 (500) and bar washer member 400 (600) having the above described structure to the clothes will be described with reference to FIGS. 22 and 23.

First, referring to FIG. 22, bar member 300 (500) is placed above clothes 800, and bar washer member 400 (600) is placed below the clothes. At this time, the bar washer member 400 (600) is placed such that the spot facing holes 402*a* (602*a*) are positioned on the side not facing the clothes 800.

Then, jig 900 for caulking bar member legs 303 (503) is arranged at a position opposing to hole 402 (602) for bar member leg. The jig may be or may not be heated provided that it causes plastic deformation of bar member leg 303 (503).

Figure 23:
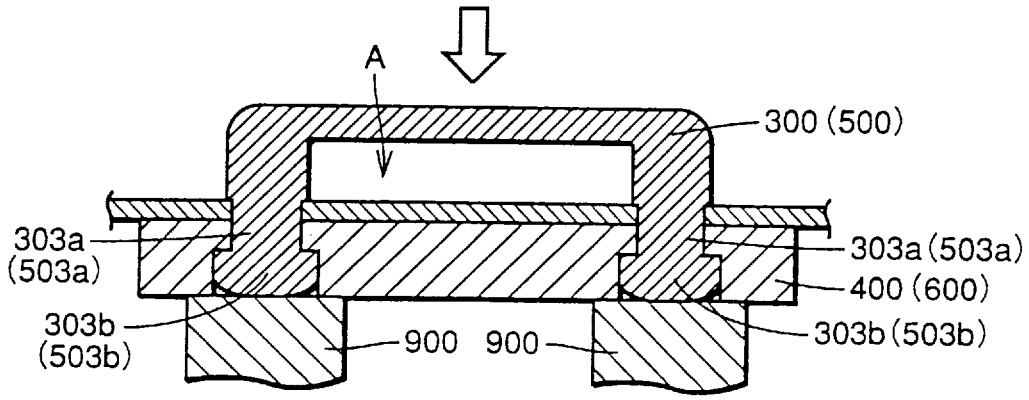
FIG. 23 is a vertical section showing a second stage of attachment of the receiving member to the clothes.

Referring to FIG. 23, bar member legs 303 (503) of bar member 300 (500) stab clothes 800, and then tip end portions 303*b* (503*b*) of bar member legs 303 (503) are caulked by jig 900. At this time, the caulked tip end portion 303*b* (503*b*) is deformed and contained within spot facing hole 402*a* (602*a*). Therefore, the caulked portion of bar member leg 303 (503) does not protrude from bar washer member 400 (600), providing neat appearance.

In this manner, the receiving member (bar) can readily and surely be attached to the clothes.

In the retaining device for clothes in accordance with the present embodiment, hook member 100 and hook washer member 200 are used as inserting member (hook), and bar member 300 and bar washer member 400 are used as receiving member (bar). As the hook member legs 116 provided on hook member 100 and bar member leg 303 provided on bar member 300 stab the clothes and hook washer member 200 and bar washer member 400 are caulked, hook member and bar member 300 can surely be attached to the clothes.

The embodiments disclosed above are examples only and not limiting. For example, though inserting members having four hook member legs have been described with reference to FIGS. 6 to 9, the number of hook member legs is not limited and any number of legs may be provided so long as the inserting member can surely be fixed on the clothes.

Figure 24:
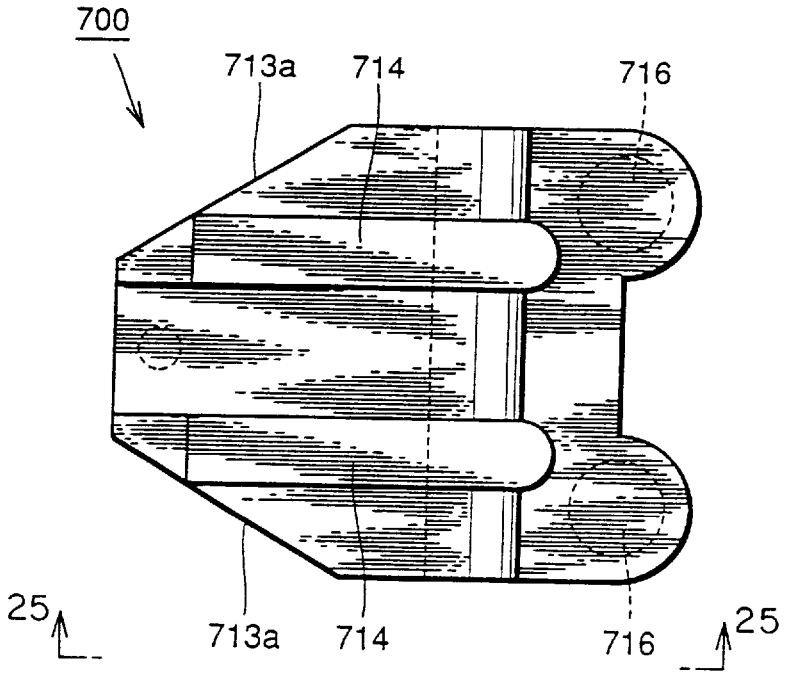
FIG. 24 is a plan view of a hook member in accordance with another embodiment of the present invention.
Figure 25:
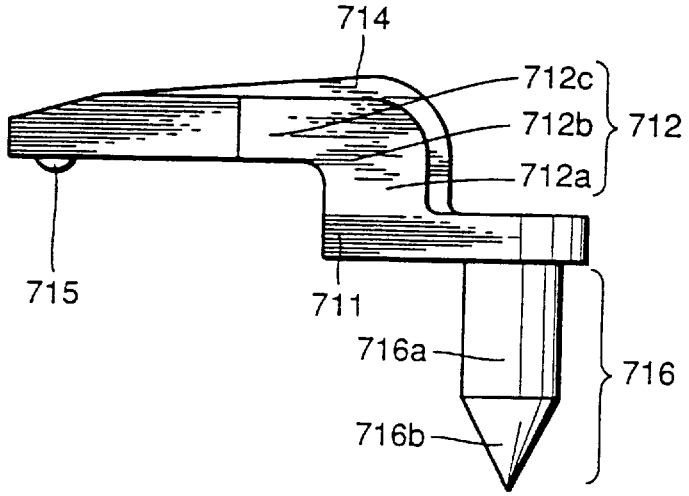
FIG. 25 is a side view taken along the line 25—25 of FIG. 24.
Figure 26:
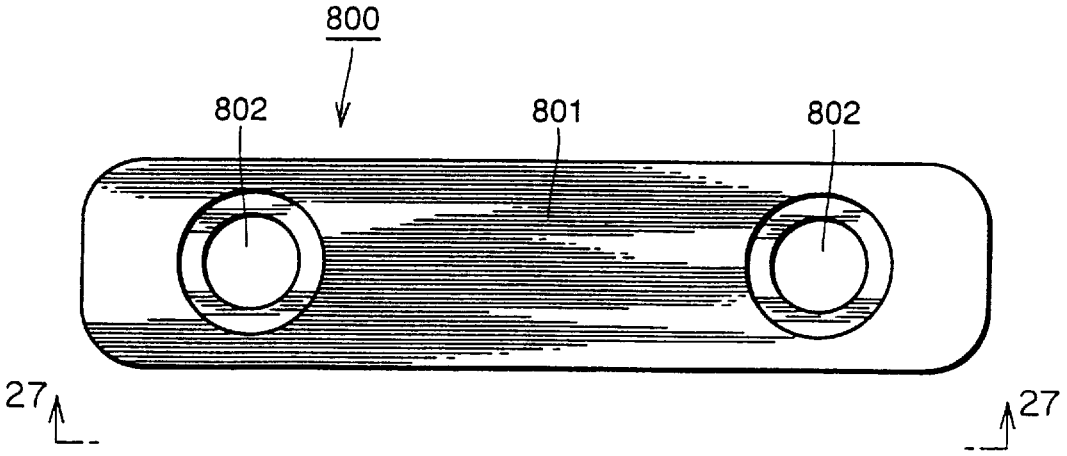
FIG. 26 is a plan view of a hook washer member in accordance with another embodiment of the present invention.
Figure 27:
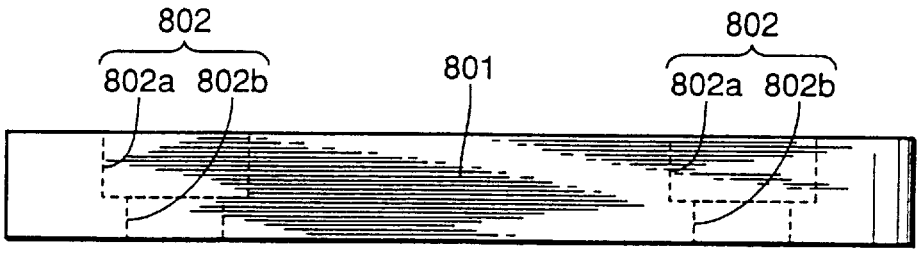
FIG. 27 is a side view taken along the line 27—27 of FIG. 26.

Therefore, similar function and effects can be obtained when hook member 700 having two hook member legs 716 and shown in FIGS. 24 and 25 and hook washer member 800 shown in FIGS. 26 and 27 are used.

Functions of base plate 711, inserting plate 712 having vertical portion 712*a*, bent portion 712*b* and horizontal portion 712*c*, taper 713*a*, rib 714 and protruding portion 715 of hook member 700, and of hook member legs 716 having bodies 716*a* and tip end portions 716*b* are the same as those of the embodiment described above. Further, functions of hook washer member 800 including hook washer base 801 and caulking holes 802 having spot facing holes 802*a* and through holes 802*b* are also the same as those of the embodiments described above.

Figure 28:
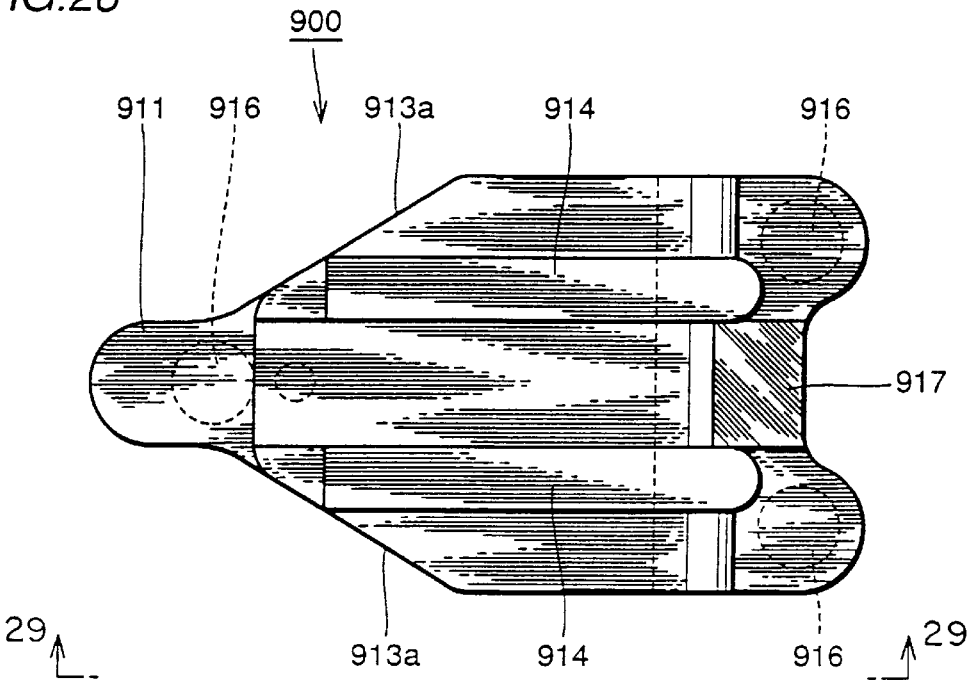
FIG. 28 is a plan view of a hook member in accordance with a still further embodiment of the present invention.
Figure 29:
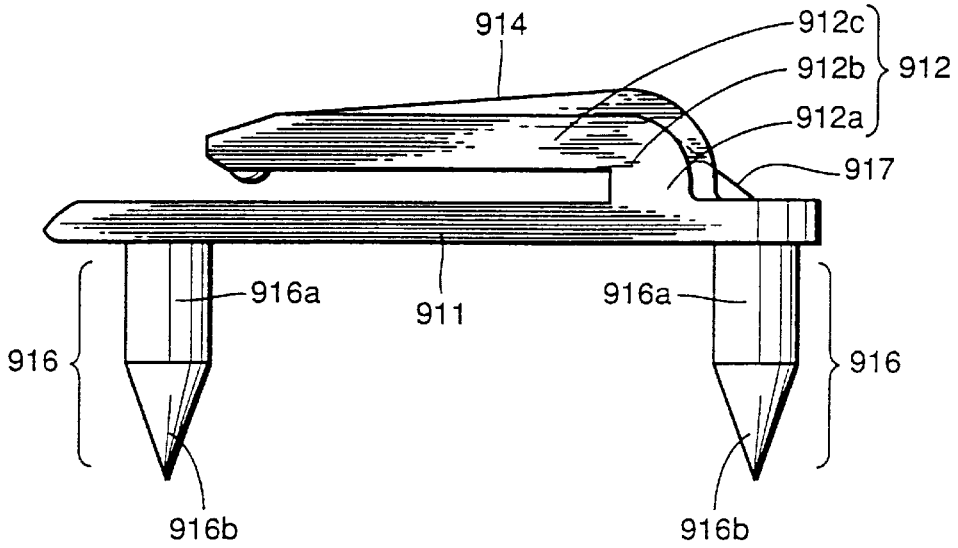
FIG. 29 is a side view taken along the line 29—29 of FIG. 28.
Figure 30:
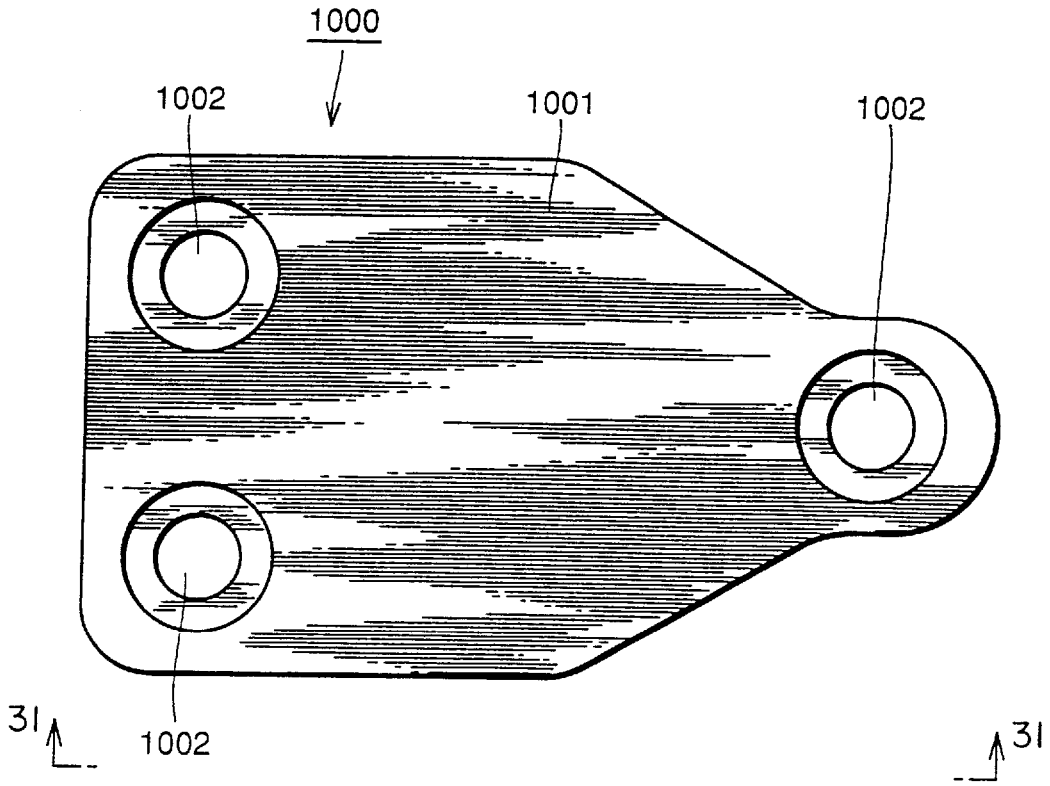
FIG. 30 is a plan view of a hook member in accordance with a still further embodiment of the present invention.
Figure 31:
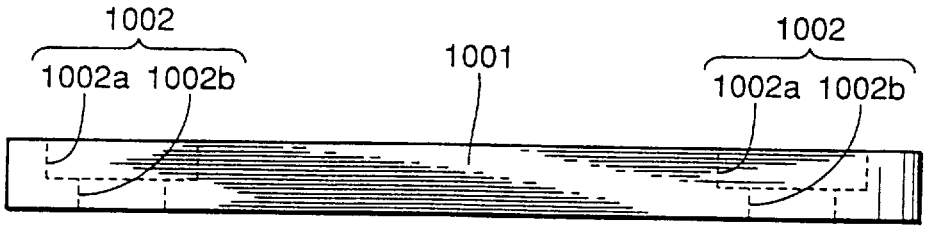
FIG. 31 is a side view taken along the line 31—31 of FIG. 30.
Figure 32:
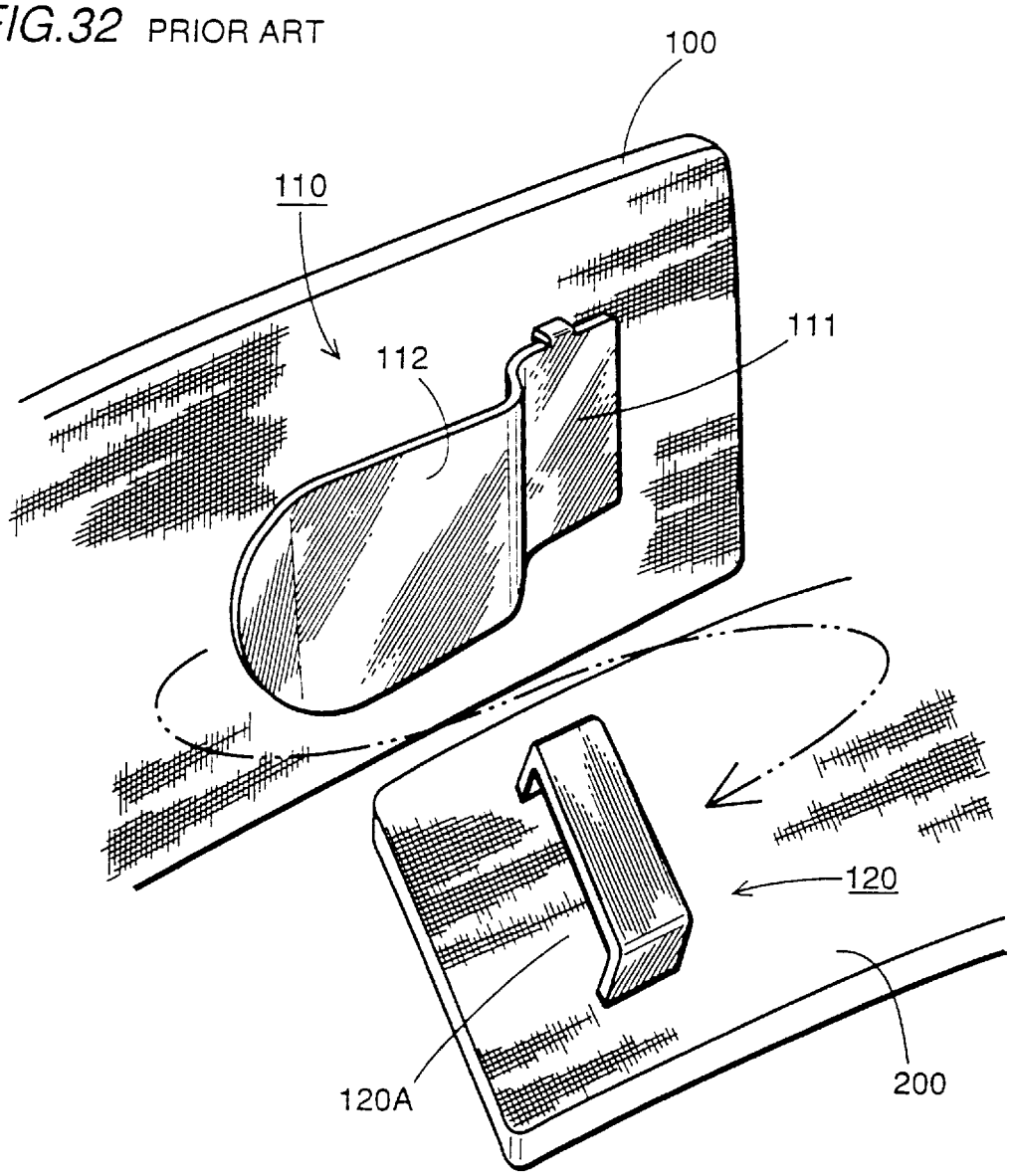
FIG.32 PRIOR ART
FIG. 32 is a schematic view showing the state of use of a conventional retaining device for clothes.

Further, when hook member 90 having three hook member legs 916 shown in FIGS. 28 and 29 and hook washer member 1000 shown in FIGS. 30 and 31 are used, similar functions and effects as the above described embodiments can be obtained.

The hook member 900 shown in FIGS. 28 and 29 is provided with a reinforcing rib 917 bridging between bent portion 912*b* and vertical portion 912*a* of inserting plate 912, between and in addition to the two ribs 194. Provision of the reinforcing rib 917 further improves elasticity of inserting plate 912.

Functions of base plate 911, inserting plate 912 including vertical portion 912*a*, bent portion 912*b* and horizontal portion 912*c*, taper 913*a*, rib 914, convex portion 915 of inserting member 900 and of hook member legs 916 having bodies 916*a* and tip end portions 916*b* are the same as those of the above described embodiments. Further, functions of hook washer base 1001 and caulking holes 1002 having spot facing holes 1002*a* and through holes 1002*b* are also the same as those of the above described embodiments.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A retaining device for clothes attached to clothes for keeping said clothes fit on one's body, including a receiving member attached to one end of said clothes and forming an opening together with said clothes, and an inserting member attached to the other end of said clothes for engaging said one and the other ends of said clothes when inserted to said opening, wherein said inserting member is formed of a plastic material and includes a base plate attached to said clothes, an inserting plate having a vertical portion extending vertically from said base plate at one end of said base plate, a bent portion bent in a direction parallel to said base plate from said vertical portion, and a parallel portion extending parallel to said base plate from said bent portion, forming, together with said base plate, a space for receiving said receiving member, a convex portion provided on an inner surface of said parallel portion of said inserting plate opposing to said base plate, serving as a stop for said receiving member in disengaging direction, for preventing said receiving member from slipping out from said space, and a rib provided protruding outward on an outer surface of said inserting plate to suppress deflection of said inserting plate.

2. The retaining device for clothes according to claim 1, wherein said rib is provided on outer surfaces of said vertical portion and said bent portion of said inserting plate.

3. The retaining device for clothes according to claim 2, wherein said rib is further provided on an outer surface of said parallel portion.

4. The retaining device for clothes according to claim 1, wherein said rib forms two protruding portions extending parallel to each other along a direction of extension of said inserting plate.

5. The retaining device for clothes according to claim 1, wherein a tip end side of said parallel portion of said inserting plate has a shape gradually becoming narrower toward the tip end, so as to facilitate insertion to said opening formed by said receiving member and said clothes.

6. The retaining device for clothes according to claim 1, wherein a gap between said parallel portion of said inserting plate and said base plate is larger than a thickness of said receiving member, and a gap between said convex portion and said base plate is smaller than the thickness of said receiving member.

7. The retaining device for clothes according to claim 1, wherein a thickness of said parallel portion of said inserting plate is approximately the same as height of the opening formed by said receiving member and said clothes.

8. The retaining device for clothes according to claim 1, wherein said base plate has a sewing hole for attaching said inserting member to said clothes at its tip end portion, and a pair of legs providing sewing holes for attaching the inserting member to said clothes on side portions.

9. The retaining device for clothes according to claim 1, wherein said receiving member is formed of a plastic material, and it has a protruding plate portion for forming, when attached to the other end of said clothes, an opening with said clothes, and leg portions provided at opposing ends of said plate portion and having holes for sewing said receiving member on said clothes.

10. The retaining device for clothes according to claim 9, wherein said plate portion is formed protruded such that height of said opening formed between said plate portion and said clothes is approximately the same as a thickness of said parallel portion of said inserting plate.

11. The retaining device for clothes according to claim 9, wherein said plate is formed protruding such that a width of said opening formed between said plate portion and said clothes is approximately the same as widths of said parallel portion of said inserting plate.

12. A retaining device for clothes attached to clothes for keeping said clothes fitted on one's body, including a receiving member attached to one end of said clothes forming, together with said clothes, an opening, and an inserting member attached to the other end of said clothes for engaging said one end and said the other end of said clothes when inserted to said opening, wherein said inserting member has a hook member to be inserted to said receiving member, and a hook washer member for fixing the hook member at said the other end of said clothes, said hook member being formed of a plastic material and including a base plate attached to said clothes, an inserting plate provided on a side of said base plate not facing said clothes, and having a vertical portion extending vertically from said base plate, a bent portion bent to a direction parallel to said base plate from the vertical portion, and a parallel portion extending parallel to said base plate from the bent portion, forming a space for receiving said receiving member, a convex portion provided on an inner surface of said parallel portion of said inserting plate opposing to said clothes, serving as a stop for said receiving member in a disengaging direction, for preventing said receiving member from slipping out from said space, a rib formed protruding outward on an outer surface of said inserting plate for suppressing deflection of said inserting plate, and a plurality of hook member legs formed on the surface of said base plate facing said clothes which can stab said clothes, said hook washer member including a washer base formed of a plastic material, and caulking holes for hook member legs provided on the washer base at positions corresponding to said hook member legs.

13. The retaining device for clothes according to claim 12, wherein said caulking holes for hook member legs each have a stop facing hole of larger diameter than the caulking holes on the side not facing said clothes.

14. The retaining device for clothes according to claim 12, wherein said receiving member has a bar member forming, together with said clothes, an opening, and a bar washer member for fixing said bar member on said one end of said clothes, said bar member being formed of a plastic material and including a main bar received by a space formed by said inserting member and said clothes, and a plurality of bar member legs provided on a surface of the main bar facing said clothes, which can stab said clothes, and said bar washer member including a bar washer base formed of a plastic material, and caulking holes for bar member legs provided in the bar washer base at positions corresponding to said bar member legs.

15. The retaining device for clothes according to claim 14, wherein said bar member legs are provided on said main bar such that width of said opening formed between said main bar and said clothes is approximately the same as width of said parallel portion of said inserting plate.

16. The retaining device for clothes according to claim 14, wherein said caulking holes for bar member legs each have a spot facing hole of larger diameter than the caulking holes on a surface not facing said clothes.

17. The retaining device for clothes according to claim 12, wherein said bar member legs include spacers having wider width than diameter of said bar member legs to define a space between said main bar and said clothes at a portion connecting to said main bar.

18. The retaining device for clothes according to claim 17, wherein thickness of said spacer is set to be approximately the same as thickness of said parallel portion of said inserting plate.

* * * * *